United States Patent [19]

Sykes et al.

[11] Patent Number: 4,503,414

[45] Date of Patent: Mar. 5, 1985

[54] CURRENT INTERRUPTING LIGHTNING ARRESTER ISOLATOR

[76] Inventors: Huey P. Sykes, 4213 Henning Dr., Concord, Calif. 94521; Richard H. Brainard, 1368 Via D'Este, Livermore, Calif. 94550

[21] Appl. No.: 505,796

[22] Filed: Jun. 20, 1983

[51] Int. Cl.[3] ..... H01H 37/36

[52] U.S. Cl. ..... 337/31; 361/124; 361/125; 361/131

[58] Field of Search ..... 361/124, 125, 131, 132; 337/17, 30, 31

[56] References Cited

U.S. PATENT DOCUMENTS

| | | | |
|---|---|---|---|
| 2,174,477 | 9/1939 | Pittman et al. | 361/124 X |
| 2,315,320 | 3/1943 | Earle | 361/125 |
| 2,516,026 | 7/1950 | Strom et al. | 361/132 X |
| 2,524,101 | 10/1950 | Earle | 337/31 |
| 2,989,608 | 6/1961 | Hicks | 361/125 X |

FOREIGN PATENT DOCUMENTS

| | | | |
|---|---|---|---|
| 782902 | 9/1957 | United Kingdom | 361/124 |
| 1172345 | 11/1969 | United Kingdom | 361/124 |

*Primary Examiner*—Harry E. Moose, Jr.

*Attorney, Agent, or Firm*—Owen, Wickersham and Erickson

[57] ABSTRACT

A device for connection to lightning arresters isolates the grounded lead and contains the resulting spark or arcing flame, including any hot particles generated when ground disconnection is made due to excessive current flow through the arrester. A central spacer member is screwed onto the existing ground lead terminal of the lightning arrester and contains an arc extinguishing channel with an internal fusible link adapted to melt in an overload condition. A shielding cup surrounds the central spacer member for containment of sparks and arcing, and a ground lead connector wire extends from the internal fusible link to a new ground lead terminal at the exterior of the shielding cup, for connection to a grounded lead. When excessive current flows through the arrester, the internal link melts, causing sparking or arcing which is substantially contained by the spacer member and the shielding cup, and which generates pressurized gases effective to push the shielding cup and grounded lead quickly away from the lightning arrester, completing the disconnect and extinguishing the arc.

12 Claims, 3 Drawing Figures

CURRENT INTERRUPTING LIGHTNING ARRESTER ISOLATOR

BACKGROUND OF THE INVENTION

The invention relates to lightning arrester devices as primarily used on electrical power lines and equipment, and more particularly to an improved current interrupting lightning arrester isolator, the use of which avoids the starting of fires around rural power poles, while still giving a visual indication that the isolator has been activated.

When lightning strikes overhead power lines and equipment that are protected by lightning arresters, it is usually diverted to ground through the lightning arrester, which has a ground lead connected to a grounding electrode. However, when current flow through the lightning arrester is excessive, the line becomes grounded and it is necessary to disconnect the ground lead so that the normal operation of the line may be resumed. Therefore, isolators have been included on lightning arresters, for disconnecting the ground lead in the event of excessive current flow through the arrester.

A type of isolator which has been in common use prior to the present invention is an explosive disconnect, usually comprising a powder charge similar to that of a 0.22 caliber bullet, encapsulated in hard plastic material. Upon excessive current flow though the lightning arrester, the powder charge was ignited and a portion of the isolator, to which the ground lead was connected, would blow away from the lightning arrester. This provided a visual indication of the failure of the lightning arrester, but resulted in fragments of hot material being ejected upon isolation of the ground lead, and these hot fragments would often cause fires in the vicinity of the power pole or other equipment.

As a result, in California, for example, clearing of all flammable material is required within ten feet of rural power poles supporting lightning arresters. This has caused considerable recurrent expense for utilities, particularly where poles exist in remote areas of rough terrain, creating a need for a ground lead disconnect device which will disconnect the ground lead when current flow exceeds a certain level, but which will not result in the ejection of any hot materials which could cause fires.

SUMMARY OF THE INVENTION

The present invention provides an improved lightning arrester isolator which effectively interrupts current and which contains all hot materials generated upon the failure of the arrester and the disconnecting of the ground lead. The isolator device of the invention, designed for attachment to the existing ground lead terminal which extends downwardly from a lightning arrester, includes an insulative spacer member having means for connection to the ground lead terminal of the lightning arrester, and a arc extinguishing channel within a bore of the spacer member, with an internal fuse or fusible link adapted to interrupt a current flow which exceeds a predetermined maximum. Associated with the insulative spacer member are means for electrically connecting the internal fusible link to the ground lead terminal of the arrester. A shielding cup surrounds the spacer member, with a base below the spacer member and a peripheral flange extending upwardly from the base into proximity with the lightning arrester and spaced outwardly from the spacer member. The internal fusible link is connected to the base of the shielding cup by a ground lead, and a base ground lead terminal connected to this ground lead, extends to the exterior of the shielding cup's base, for receiving a ground conductor. Releasable attachment means normally hold the shielding cup in position surrounding the spacer member. When electrical current flow exceeds the predetermined maximum, the internal link melts, causing a sparking which is substantially contained by the spacer member and shielding cup. This sparking generates expansive gases which are effective to push the shielding cup and grounded lead away from the lightning arrester, completing the separation and extinguishing the arc.

Preferably, the conducting device which connects the internal fusible link to the existing ground lead terminal of the lightning arrester comprises a conductive metal insert which is secured into the spacer member by molding the spacer member around it, the conductive insert having a thread for receipt of the arrester's ground lead terminal. The fusible link assembly may comprise a pair of metal rods, one extending down from the conductive metal insert into the bore of the spacer member, and another extending up from the base of the shielding cup, with a fusible link or a plug of solder between and connecting the two rod sections. There may be an anti-torque device coacting between the shielding cup and the spacer member, for preventing rotation of the shielding cup with respect to the spacer member in the normal, non-failure mode. This prevents any such rotation, and consequent possible breakage of the internal fusible connection, when a grounded lead is tightened onto the base ground lead terminal extending from the bottom of the isolator. The anti-torque device may simply comprise one or more nipples extending up from the shielding cup's base, into corresponding recesses in the spacer member.

In accordance with the invention, sparking and arcing are substantially contained within the insulative spacer member and the surrounding shielding cup in a failure condition wherein the fusible link is melted by an excessive current flow. Any hot fragments generated by the device are contained within these components for a sufficiently long period to prevent their starting fires, and the isolator gives a definite visual indication that the disconnect has taken place.

These and other objects, advantages, features and characteristics of the invention will be apparent from the description of preferred embodiments below, considered along with the accompanying drawings.

DESCRIPTION OF PREFERRED EMBODIMENTS

Figure 1:
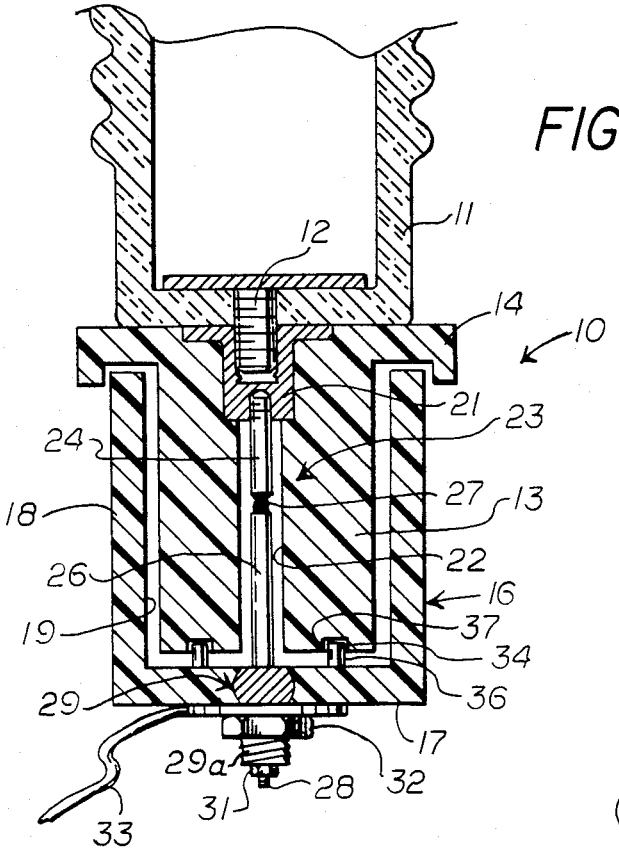
FIG. 1 is a view in sectional elevation showing one form of a lightning arrester isolator according to the invention, connected to a typical lightning arrester having a depending threaded ground lead connector.

In the drawings, FIG. 1 shows a current interrupting lightning arrester isolator 10 according to the invention retained to the bottom of a lightning arrester 11 of typical configuration by screwing it onto an existing ground lead connector stud 12 as typically extends from such an arrester. The isolator 10 includes an electrically insulative spacer member 13, of arc extinguishing plastic material, with a cap portion 14 that may be integral with the rest of the spacer member, as shown, or may be formed separately and bonded to the portion 13. A shielding cup 16 has a base 17 and a peripheral flange 18 which closely surrounds the spacer member 13, with limited space 19 between the cup and spacer member.

The spacer member 13 is held to the lightning arrester by a threaded conductive metal insert 21, which may be captive-molded into the plastic spacer member, to make the threaded connection with the stud 12 of the lightning arrester. Below the lower end of the insert 21 is a central bore 22 through the remainder of the spacer member, this bore serving as an arc extinguishing channel with an internal fuse or fusible link generally indicated at 23 enclosed therein.

The fusible link 23 may advantageously comprise a pair of conductive metal rods 24 and 26, the upper rod 24 being secured to the conductive insert 21 above, as by the threaded connection shown. Between the rods, and electrically connecting them, is a fusible material 27 which may be a plug of solder in this embodiment.

The fusible link 23, i.e. the two solder-connected rods 24 and 26, preferably function to hold the shielding cup 16 in place, in the embodiment of FIG. 1. The rod 26, or a reduced-diameter portion 28, may pass directly through a lower conductive metal insert 29 which is molded into the base 17 of the cup 16 and includes a threaded portion 29*a*, serving as a ground lead terminal. The rod 26 or its reduced diameter portion 28 may have a threaded lower end receiving a nut 31, to thereby hold the assembly together. A larger nut 32 can secure a grounded lead wire 33 to the isolator.

If the fuse assembly 23 itself holds the cup and spacer member assembly together, as in FIG. 1, the fusible link 23 will need protection against being twisted apart when the isolator 10 is screwed onto the terminal 12 of the lightning arrester. Thus, anti-torque devices 34 may be included between the cup and spacer member, preferably comprising one or more molded studs 36 engaging recesses 37, either as shown in the drawing or with the studs on the spacer member 13.

In operation, an excessive current flows, in excess of a predetermined limit which may be 1200 amperes, the solder plug 27 melts to make the break, being so configured to establish the pre-set current limit. The breaking of the connection causes considerable arcing and sparking, but all this is contained within the channel 22 and the outer cup 16, for a sufficient period of time to quench the arcing flame and contain any hot particles long enough to prevent their causing fires in the vicinity of the power pole or other installation.

The melting of the fusible link generates hot expansive gases within the channel 22. Preferably, the material of the spacer member is Delrin (a form of nylon), which with the arcing flame and heat tends to generate flame-quenching gases, as is known to those skilled in the art. The result is that the arcing flame is quenched even more quickly and efficiently.

The expanding gases from the break are effective to blow the shielding cup 16 downward, away from the spacer member 13 and the lightning arrester 11. This both helps complete the disconnect quickly and gives a visual confirmation that the failure has occurred.

Figure 2:
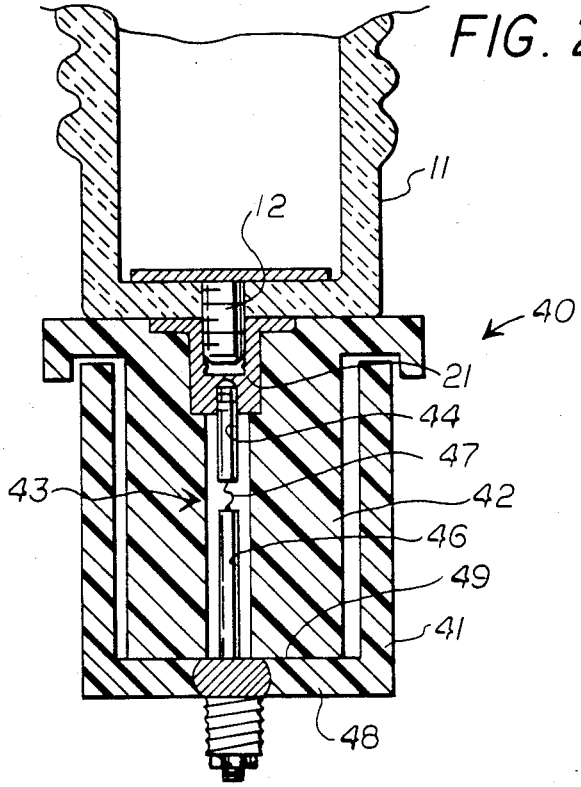
FIG. 2 is a similar view showing the isolator with a different type of internal fuse.

FIG. 2 shows a similar lightning arrester isolator 40 to that shown in FIG. 1, but with two modifications: in the type of fuse assembly used, and in the manner of protecting against twisting of the fuse on connection of the isolator to the lightning arrester 11, which relates to the manner in which the shielding cup 41 is retained to the spacer member 42. It should be understood that any of these modifications can be made separately to the form of the invention shown in FIG. 1.

In the embodiment shown in FIG. 2, a fuse assembly 43 may comprise a pair of conductive metal rods 44 and 46 as in FIG. 1, but with a different type of fuse element 47, in this case being a fuse wire designed to melt or "blow" at a specified current level, such as 1200 amperes. It is connected to the two rods 44 and 46 by any suitable means, such as swaging into small openings (not shown) in the ends of the rods, or by high-temperature soldering. The fuse element 47 may alternatively comprise a compression spring positioned and held appropriately between the two rod ends, particularly in conjunction with the type of shielding cup retention shown in connection with this embodiment.

In FIG. 2 the shielding cup's base 48 bears directly against the spacer member 42 above, and is retained to it by a releasable attachment means, such as a soft glue 49. The soft glue will release when a failure occurs, i.e. the fuse disconnects the current, due to heat and pressurized gases generated. Also, the soft glue bonds the two components sufficiently in shear, that the fuse assembly 43 is protected against twisting apart when the isolator unit 40 is installed. Alternatively, other suitable forms of releasable attachment may be used.

Figure 3:
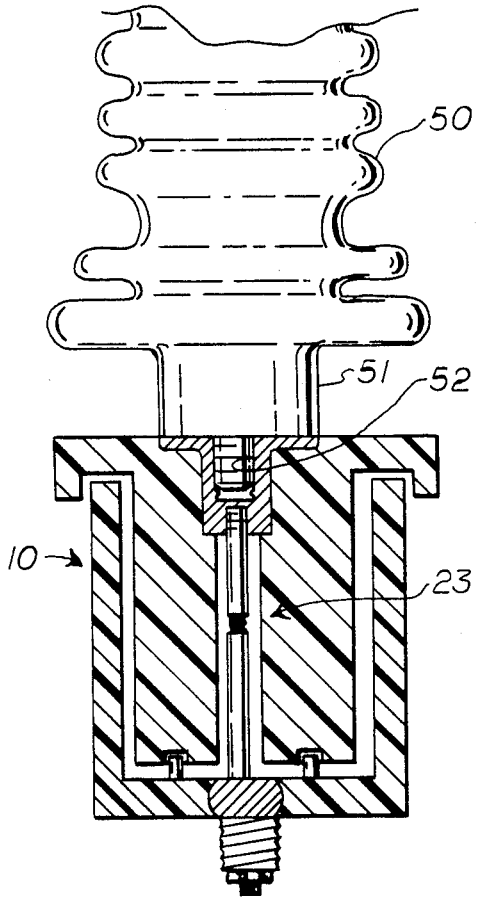
FIG. 3 is another similar view, but showing the isolator connected to a different type of lightning arrester.

FIG. 3 shows a lightning arrester isolator 10 similar to that of FIG. 1, but connected to a different type of lightning arrester 50. The arrester 50, also of typical configuration common in the prior art, has a relatively narrow protrusion 51 at its lower end, containing an explosive type disconnect device as described above. Those disconnect devices were designed to fracture the ceramic protrusion 51 to separate the ground lead terminal 52 from the body of the arrester in a failure condition. With the isolator 10 attached to the arrester 50, the fuse 23 can be selected to "blow" under slightly lower current overload conditions than the explosive disconnect in the protrusion 51.

It should be understood that the term "fuse" as used herein and in the appended claims is intended to encompass any type of fusible link which will melt upon the occurrence of excessive current flow. Also, the terms "up", "down", "above", "below", etc. are used for convenience of illustration and description, but are not meant to be limiting as to the orientation of the isolator.

The embodiments described herein are illustrative of the principles of the invention but are not intended to limit the scope of the invention. Variations to these preferred embodiments will be apparent to those skilled in the art and may be made without departing from the essence and scope of the invention.

We claim:

1. A lightning arrester isolator, for attachment to a lightning arrester having a ground lead terminal, comprising:

an insulative spacer member, with means for connection to the ground lead terminal of the lightning arrester;

an arc extinguishing channel within a bore of the spacer member, with an internal fuse adapted to interrupt a current flow which exceeds a predetermined maximum;

means for electrically connecting the internal fuse to the ground lead terminal of the lightning arrester;

a shielding cup surrounding the spacer member, having a base below the spacer member and a peripheral flange extending upwardly from the base into proximity with the lightning arrester and spaced outwardly from the spacer member;

a fuse to the ground lead connected to the internal fuse and to the base of the shielding cup;

a base ground lead terminal on the exterior of the base, for receiving a grounded lead, and being connected to the fuse to ground lead;

releasable attachment means for normally holding the shielding cup in position surrounding the spacer member;

whereby, when an electrical current flows exceeding said predetermined maximum, the internal fuse melts, causing a sparking which is substantially contained by the spacer member and shielding cup, the sparking generating expansive gases which are effective to push the shielding cup and grounded lead away from the lightning arrester.

2. The lightning arrester isolator of claim 1, wherein the means for connection to the ground lead terminal of the lightning arrester comprises a conductive member secured in the spacer member and having a first threaded bore screwed onto the ground lead terminal of the lightning arrester, said conductive member being in conductive connection with the internal fuse, thereby also serving as said means for electrically connecting the internal fuse to the ground lead terminal.

3. The lightning arrester isolator of claim 2, wherein the conductive member has a second threaded bore opposite and concentric with said first threaded bore, with a threaded connector screwed into the second threaded bore and connected to the internal fuse in arc extinguishing channel.

4. The lightning arrestor isolator of claim 3, wherein the internal fuse comprises a pair of conductive metal rods arranged end to end with a solder joint between them, an upper one of the two rods being threaded at its upper end and serving as said threaded connector, and a lower one of the rods serving as at least a part of the fuse to ground lead.

5. The lightning arrester isolator of claim 1, wherein the internal fuse comprises a pair of conductive metal rods arranged end to end with a solder joint between them, a lower one of the two rods serving as at least a part of the fuse to ground lead.

6. The lightning arrester isolator of claim 1, wherein the internal fuse serves as the releasable attachment means.

7. The lightning arrester isolator of claim 6, further including anti-torque means for preventing rotation of the shielding cup with respect to the spacer member in the normal configuration of the lightning arrester isolator.

8. The lightning arrester isolator of claim 7, wherein the anti-torque means comprises at least one stud on one of the shielding cup and the spacer member, and a corresponding recess in the other, into which the stud extends.

9. The lightning arrester isolator of claim 7, wherein the anti-torque means and the releasable attachment means comprise a releasable bonding of the shielding cups base to the lower end of the spacer member.

10. The lightning arrester isolator of claim 1, wherein the releasable attachment means comprises a releasable bonding of the shielding cup's base to the lower end of the spacer member.

11. The lightning arrester isolator of claim 1, further including a top cover interposed between the top of the spacer member and the lower end of the lightning arrester, having a peripheral rim extending downward into overlapping and surrounding relationship to the peripheral flange of the shielding cup, to aid containment of the sparking upon breaking of the fuse.

12. The lightning arrester isolator of claim 1, wherein the internal fuse comprises a conductive metal rod in the upper end of the arc extinguishing channel and serving as part of said electrically connecting means, and a fuse wire extending downward from the metal rod.

* * * * *